US010828758B1

(12) United States Patent
Demro

(10) Patent No.: US 10,828,758 B1
(45) Date of Patent: Nov. 10, 2020

(54) TORSION SPRING WINDING TOOL

(71) Applicant: Brian Peter Demro, Appleton, WI (US)

(72) Inventor: Brian Peter Demro, Appleton, WI (US)

( * ) Notice: Subject to any disclaimer, the term of this patent is extended or adjusted under 35 U.S.C. 154(b) by 148 days.

(21) Appl. No.: 15/994,780

(22) Filed: May 31, 2018

Related U.S. Application Data

(60) Provisional application No. 62/514,637, filed on Jun. 2, 2017.

(51) Int. Cl.
*B25B 27/30* (2006.01)
*E05D 13/00* (2006.01)

(52) U.S. Cl.
CPC ..... *B25B 27/30* (2013.01); *E05D 13/1261* (2013.01); *E05Y 2201/492* (2013.01); *E05Y 2800/692* (2013.01); *E05Y 2900/106* (2013.01)

(58) Field of Classification Search
CPC ... B25B 27/30; B25B 13/488; E05D 13/1261; E05Y 2201/492; E05Y 2800/692; E05Y 2900/106
USPC ..... 81/52
See application file for complete search history.

(56) References Cited

U.S. PATENT DOCUMENTS 1,050,746 A * 1/1913 Morgan ..... B25B 27/304 254/10.5
1,056,084 A * 3/1913 Bates ..... H01K 3/32 81/53.12
1,208,449 A * 12/1916 Attwasser ..... B25B 13/488 81/55
1,725,613 A * 8/1929 Bolt ..... B25B 7/00 81/417
2,483,379 A * 9/1949 Brell ..... B25B 27/20 29/229
2,599,489 A * 6/1952 Schmidt ..... B25B 13/488 81/9.24
3,651,719 A 3/1972 Wessel
3,921,761 A 11/1975 Votroubek et al.
3,958,470 A 5/1976 Lee
4,142,283 A * 3/1979 Walker ..... B25B 13/48 29/227
4,467,676 A * 8/1984 Ikeda ..... B25B 21/001 81/177.1
5,605,079 A 2/1997 Way
6,508,461 B1 1/2003 Trevorrow et al.
8,336,362 B2 * 12/2012 Frenken ..... B21D 39/04 72/416
8,567,567 B1 10/2013 Turner et al.
8,936,063 B1 1/2015 Trujillo et al.
(Continued)

*Primary Examiner* — Hadi Shakeri
*Assistant Examiner* — Marcel T Dion
(74) *Attorney, Agent, or Firm* — Brannen Law Office, LLC

(57) ABSTRACT

The present invention relates to a torsion spring winding tool, and in particular to a tool having two bars that are joined with a connector. Each bar can have a shaft with two ends. Two collars are connected to each shaft, generally near the second end of the shafts. The collars separate the bars into three sections, namely a handle, a seat and a lug. A connector is provided and connects the bars together in the seats. The connector can be a spring that is covered with a cover. A user can use the handles to manipulate the bars. The lugs can be inserted into pockets of a spring cone to wind and unwind a torsion spring.

11 Claims, 10 Drawing Sheets

(56) References Cited

U.S. PATENT DOCUMENTS

| | | | | |
|---|---|---|---|---|
| 9,273,504 | B2 | 3/2016 | Schutt | |
| 2005/0056123 | A1 * | 3/2005 | Primrose | B25B 27/30 81/58.2 |

* cited by examiner

TORSION SPRING WINDING TOOL

This United States utility patent application claims priority on and the benefit of provisional application 62/514,637 filed Jun. 2, 2017, the entire contents of which are hereby incorporated herein by reference.

BACKGROUND OF THE INVENTION

1. Field of the Invention

The present invention relates to a torsion spring winding tool, and in particular to a tool having two bars that are joined with a connector.

2. Description of the Related Art

Many overhead doors have an assist mechanism to aid in the raising of the door from a deployed position to a storage position. One type of assist mechanism is a torsion spring. The torsion spring is typically placed concentrically around a spring support. One end of the spring is anchored to a bearing plate, which is anchored to a wall. The other end of the spring is fixed to the spring support with a spring cone after a predetermined amount of spring tension is placed upon the spring. As the door moves from the storage position to the deployed position, additional spring tension is added to the torsion spring so that more assisting force is provided when the door is fully closed or deployed.

Some examples of tools include:

U.S. Pat. No. 3,651,719 to Wessel is titled Overhead Door Torsion Spring Adjusting Tool. It shows a split sleeve clamp member for removable securement about and keying to a rotatable sleeve anchor for a torsion spring. The clamp member includes outer ratchet teeth and a pair of lever members are removably journaled from the clamp member and include reversible spring-urged detent members engaged with the teeth on the clamp member for rotating the sleeve clamp member, and thus the sleeve anchor, in a preselected direction in response to oscillation of the lever members.

U.S. Pat. No. 3,921,761 to Votroubek et al is titled Method and Means of Winding Torsion Spring. It shows that the torsion spring winding device of the present invention comprises a gear having annular teeth thereon and additionally having means for detachably securing the gear to the free end of a torsion spring. A worm gear support is rotatably mounted to the gear so as to permit the gear to rotate independently of the worm gear support. The worm gear support carries an elongated worm gear in driving engagement with the annular teeth of the gear, and additionally includes a stop means for engaging the wall upon which the torsion spring is mounted. The method of the present invention comprises attaching a rotatable gear member having a plurality of peripheral teeth thereon to the free end of a torsion spring, engaging the peripheral teeth of the gear member with a worm gear, holding the worm gear mechanism against swinging movement with respect to the spring whereby the worm gear prevents rotation of the gear member and the free end of the spring with respect to the fixed end of the spring, rotating the worm gear to drive the gear member in a rotational direction whereby the free end of the torsion spring is rotated with respect to the fixed end thereof, and detaching and removing the gear member from the spring.

U.S. Pat. No. 3,958,470 to Lee is titled Double Acting Ratchet Wrench with Cam Actuated Oscillatory Pawl. It shows an improved double acting ratchet wrench employing a cam actuated positive drive oscillatory pawl which is engageable by a slight movement of the wrench handle and held tightly engaged by hand pressure on the handle.

U.S. Pat. No. 5,605,079 to Way is titled Torsion Spring Tensioning Tool. It shows a tool for applying rotational force to a coiled torsion spring of a door counterbalancing mechanism in order to wind the spring storing energy within the body of the spring. The tool includes a splittable housing which is fixedly mounted onto the winding cone of the torsion spring. The housing has a sprocket mounted thereon. On either side of the sprocket are annular grooves. Within one annular groove is to be located a right hand operated ratchet tool with a left hand ratchet tool connecting with the other annular groove. These ratchet tools are to be used sequentially in unison to create stored energy within the torsion spring.

U.S. Pat. No. 6,508,461 to Trevorrow et al. is titled Method and Apparatus for Spring Tensioning. It discloses an improved arrangement for the operation of an overhead garage door that comprises an adapter utilized for installation and periodic maintenance of the support arrangement. Also disclosed is an adapter for use with existing garage door structures, improved wrenches for use in tensioning coil springs usually found in such arrangements and a method for tensioning such coil springs when they are originally installed or during periodic maintenance of the springs. The adapter comprises a body that may be mounted upon a rotatable shaft that supports the coil springs and be non-rotatabley attached to an end of the coil spring and the rotatable shaft. The attachment to the shaft is a releasable connection and the body has splines or projecting abutment surfaces so that two of the improved wrenches according to the present invention may have their jaws closely surround and engage the splines on the body. For already existing structures the adapter has an end that is designed to attach to the collar already in place and also be attached to the end of the coil spring. The wrenches have releasable latch means that are designed to engage and disengage with the splines on the adapter body. The method according to the present invention comprises engaging and rotating the splines with the wrenches in an alternate manner such that the coil spring is wound to make the tension greater or less as one desires.

U.S. Pat. No. 8,567,567 to Turner et al. is titled Winding Tool for Torsion Spring for Sectional Garage Door. It shows a winding tool for tightening a torsion spring for a sectional overhead door. The winding tool features two half hub assembles that wrap around an overhead door shaft, wherein a translational sprocket is disposed on the hub assemblies. The hub assemblies connect to the winding cone of a torsion spring via fingers that engage the hub assemblies. A winding box is removably attached to the hub assemblies. The winding box features a worm gear that engages the translational sprocket. A handle bar can be rotated with a drill to cause rotation of the worm gear. Rotation of the worm gear causes rotation of the translational sprocket and ultimate winding of the torsion spring.

U.S. Pat. No. 8,936,063 to Trujillo et al. is titled Garage Door Spring Winding System. It shows a system for safely and effectively winding a garage door spring features a hub assembly having a cylindrical hub with a cylindrical channel located there through. The hub assembly features a wheel gear located around the hub and a plurality of engagement prongs designed to snuggly engage a torsion spring winding cone. The hub assembly is divided into a first hub component and a second hub component. The system features a base with a semi-cylindrical notch and an arcuate lid pivotally located thereon. A plurality of support rollers are adjustably located around an inside of the notch and the lid. The hub assembly is positioned on the support rollers. A worm gear that interfaces with the wheel gear is attached to a drive shaft assembly that features a drive shaft that extends from the base for remote operation of the worm gear.

U.S. Pat. No. 9,273,504 to Schutt is titled Spring Winding Device for Use with Overhead Doors. It shows a spring winding device, a counterbalancing force adjustment device for a counterbalancing mechanism, and a method of adjusting an amount of force stored in a spring of a counterbalancing mechanism are provided. The spring winding device includes a support bracket, a worm gear, and a drive gear. The worm gear is rotatably coupled to the support bracket and includes a mount portion for coupling a first end cone thereto. The drive gear is rotatably disposed adjacent the support bracket and is drivingly engaged with the worm gear. A rotation of the drive gear causes the worm gear to rotate within the support bracket. The spring winding device does not require pretensioning using winding rods, maintains rigidity and alignment when a counterbalancing force is applied, and decreases a cost and a complexity of the counterbalancing mechanism.

United States Patent Application Publication 2005/0056123 to Primrose et al. is titled Torsion Spring Tensioning Apparatus. It shows an apparatus for tensioning torsion spring, shaft-mounted in association with a spring cone, has a central ratchet assembly with two spaced, cogged ratchet wheels, slotted to allow the assembly to be rotatably positioned over the shaft. The ratchet assembly is connectable to the spring cone so that the spring cone will rotate with the ratchet assembly. The ratchet wheel slots are closed off by cogged bridging members that create a continuous cogged perimeter around each ratchet wheel. Pawl-equipped levers are positioned over the ratchet wheels with the pawls engageably aligned with the ratchet wheel cogs, and then operated in alternating fashion to rotate the ratchet assembly and spring cone, thus tensioning the spring. Upon achieving a desired spring tension, the spring cone may be secured to the shaft, whereupon the bridging members may be retracted from the ratchet wheel slots to permit removal of the apparatus from the shaft.

None of the items shown in these references represent the present invention or solve the problems solved by the present invention. Thus, there exists a need for a torsion spring winding tool that solves these and other problems.

SUMMARY OF THE INVENTION

The present invention relates to a torsion spring winding tool, and in particular to a tool having two bars that are joined with a connector. Each bar can have a shaft with two ends. Two collars are connected to each shaft, generally near the second end of the shafts. The collars separate the bars into three sections, namely a handle, a seat and a lug. A connector is provided and connects the bars together in the seats. The connector can be a spring that is covered with a cover. A user can use the handles to manipulate the bars. The lugs can be inserted into pockets of a spring cone to wind and unwind a torsion spring.

According to one advantage of the present invention, the two bars are movable relative to each other. The bars are connected with a connector and are allowed unrestricted movement relative to each other as bound by the connector. This allows the user to manipulate the position and orientation of one bar relative to the other one with relative ease.

To further this advantage, the connector has loops on each end. This advantageously allows the connector to rotate freely relative to each bar.

Collars are advantageously provided upon the shaft of each bar. The collars define a handle, a seat and a lug on each bar. The connector is connected to each bar within the seat. In addition to being rotatable relative to the bar, the connector can also longitudinally move relative to the shaft within the longitudinal span bound by the collars. This allows for an increased degree of position and orientation between the bars.

The collar closest to the second end of the bar can also serve as a depth indicator. That is, when the lug is inserted into a pocket of the spring cone, the collar can provide a visual indication that the lug is fully received within the pocket. In one embodiment, the collar can abut the perimeter of the spring cone when the lug is fully received within the pocket.

In use, the user can place the lug of one bar into a pocket and wind the spring with a chosen hand. When doing this, the second bar cannot be dropped since it is connected to the first bar with a connector.

The user can then stretch the connector so that the second bar lug is in proximity to a desired adjacent pocket. The spring force of the connector can pull and automatically move or snap the lug into the pocket. Further, the spring force retains the position of the bars within the respective pockets. This allows the user to switch hands if desired (in case where a user prefers to use a certain hand to wind the spring) while not having to worry about a bar dropping out of the pocket.

According to another advantage of the present invention, the cover can protect the spring from damage.

Further, the cover can serve as a spring expansion limit. The length of spring expansion can be set to prevent overextension of the spring.

Still further, the cover prevents items, such as clothing or other things, from becoming ensnared in the spring thereby enhancing user safety.

According to a still further advantage yet of the present invention, the two bars, on account of being connected, are unlikely to roll off of ladder or surface. This prevents the time waste and safety concerns that are associated with having individual bars fall off from a ladder or surface.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
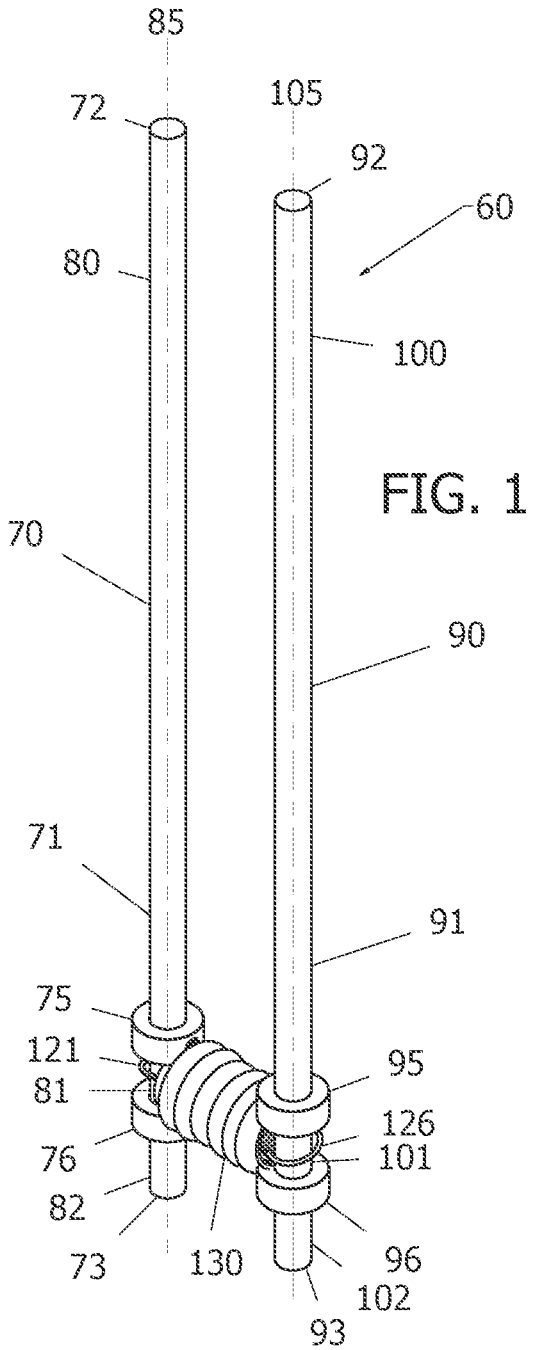
FIG. 1 is a perspective view of a preferred embodiment of the present invention.
Figure 3:
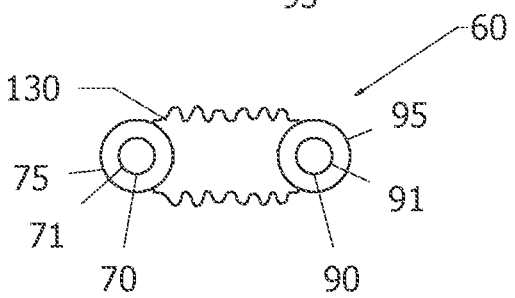
FIG. 3 is an end view of the embodiment illustrated in FIG. 1.
Figure 2:
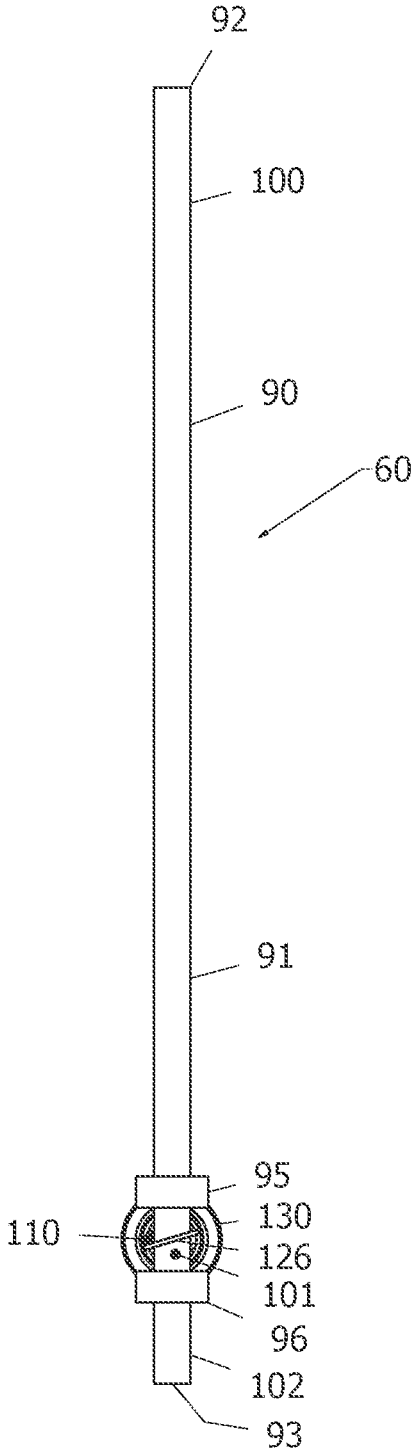
FIG. 2 is a side view of the embodiment illustrated in FIG. 1.
Figure 4:
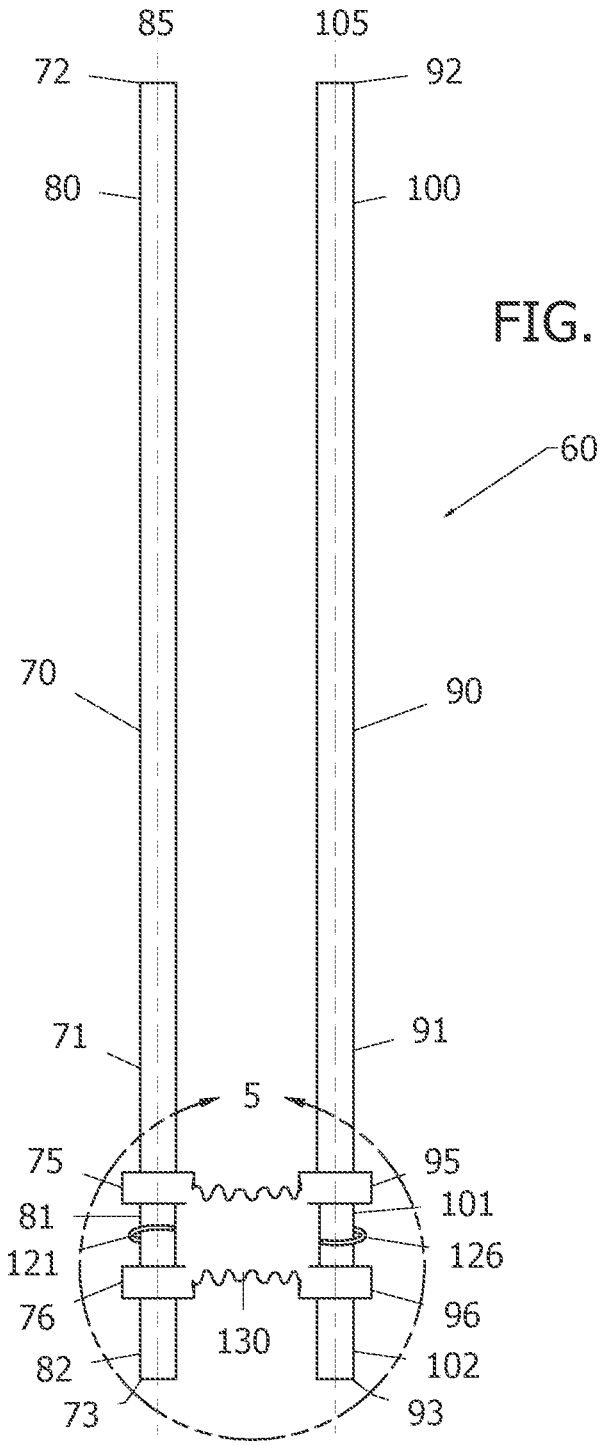
FIG. 4 is an alternative side view of the embodiment illustrated in FIG. 1.
Figure 5:
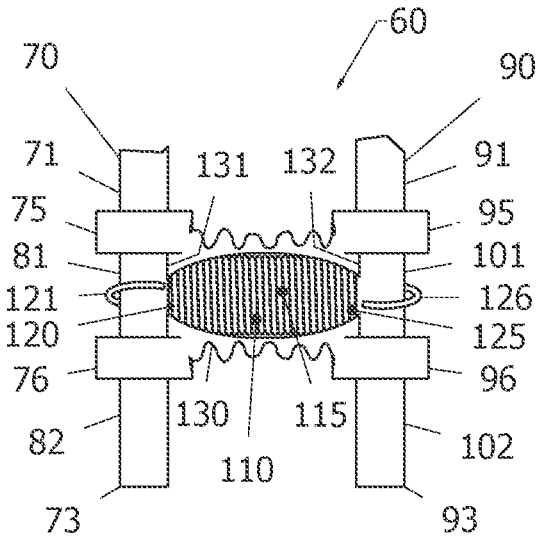
FIG. 5 is a partial cutaway view taken along Circle-5 in FIG. 4.
Figure 6:
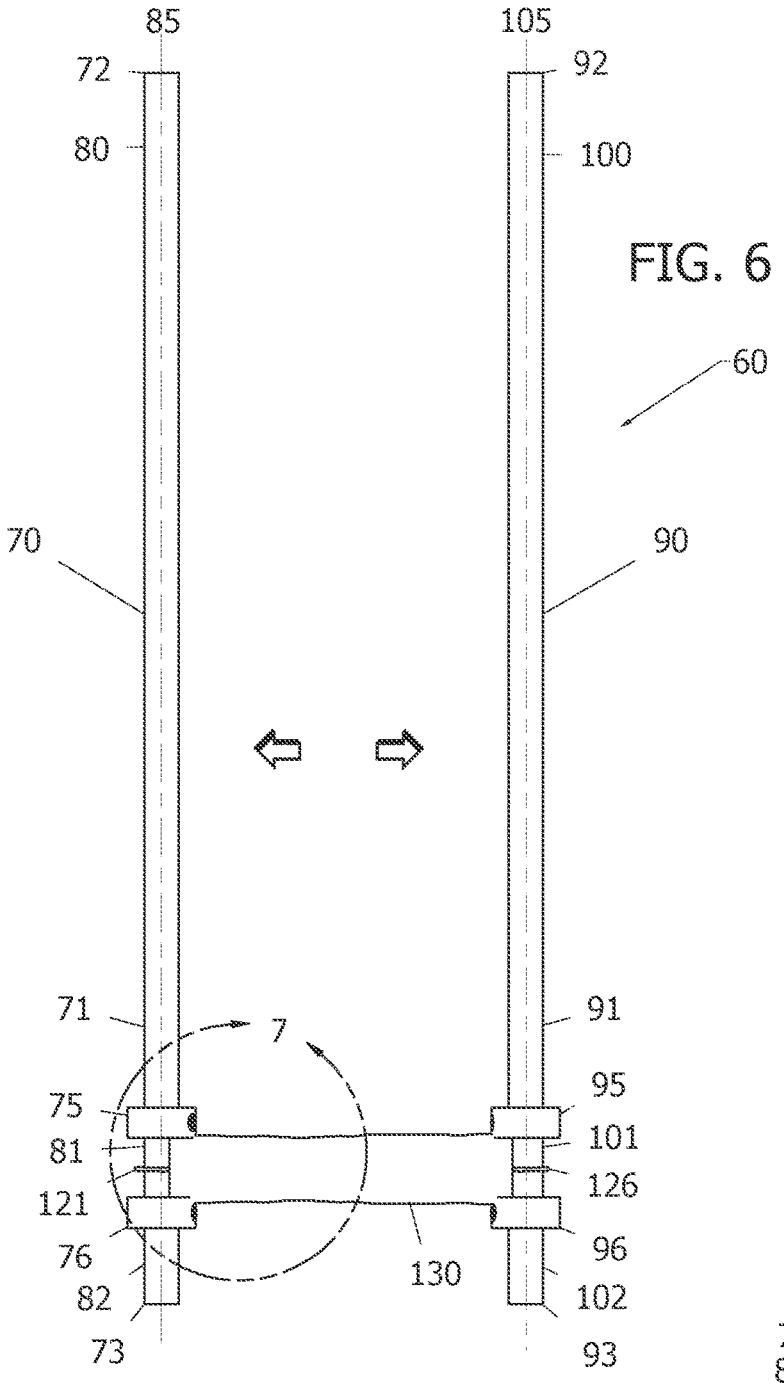
FIG. 6 is similar to FIG. 4, but instead illustrates the connector in an expanded state.
Figure 7:
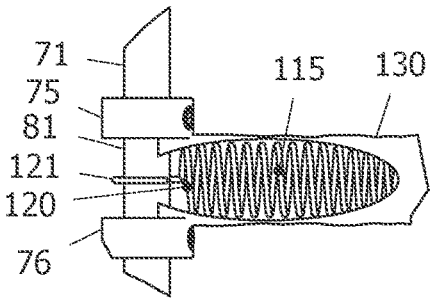
FIG. 7 is a partial cutaway view taken along Circle-7 in FIG. 6.
Figure 8:
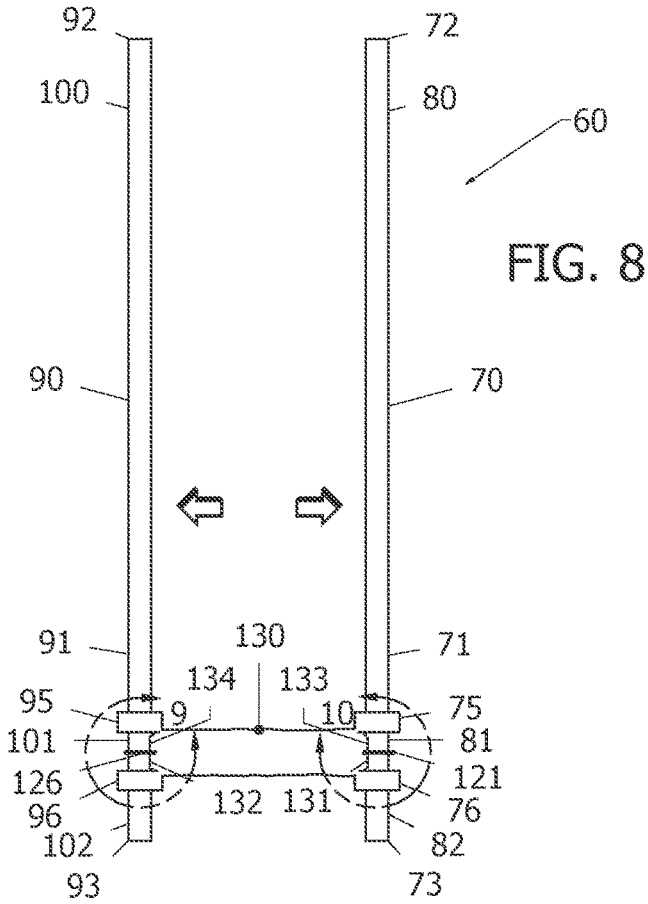
FIG. 8 is a reverse side view of the view illustrated in FIG. 6
Figure 9:
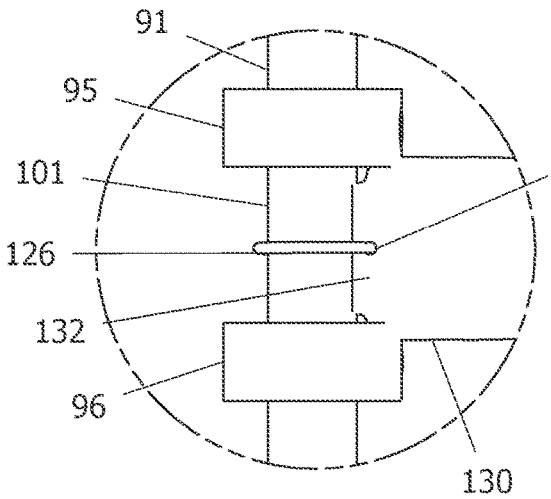
FIG. 9 is a close-up view taken along Circle-9 in FIG. 8.
Figure 10:
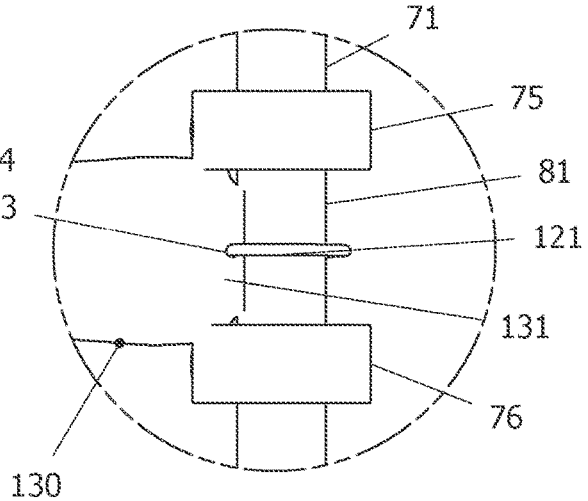
FIG. 10 is a close-up view taken along Circle-10 in FIG. 8.
Figure 11:
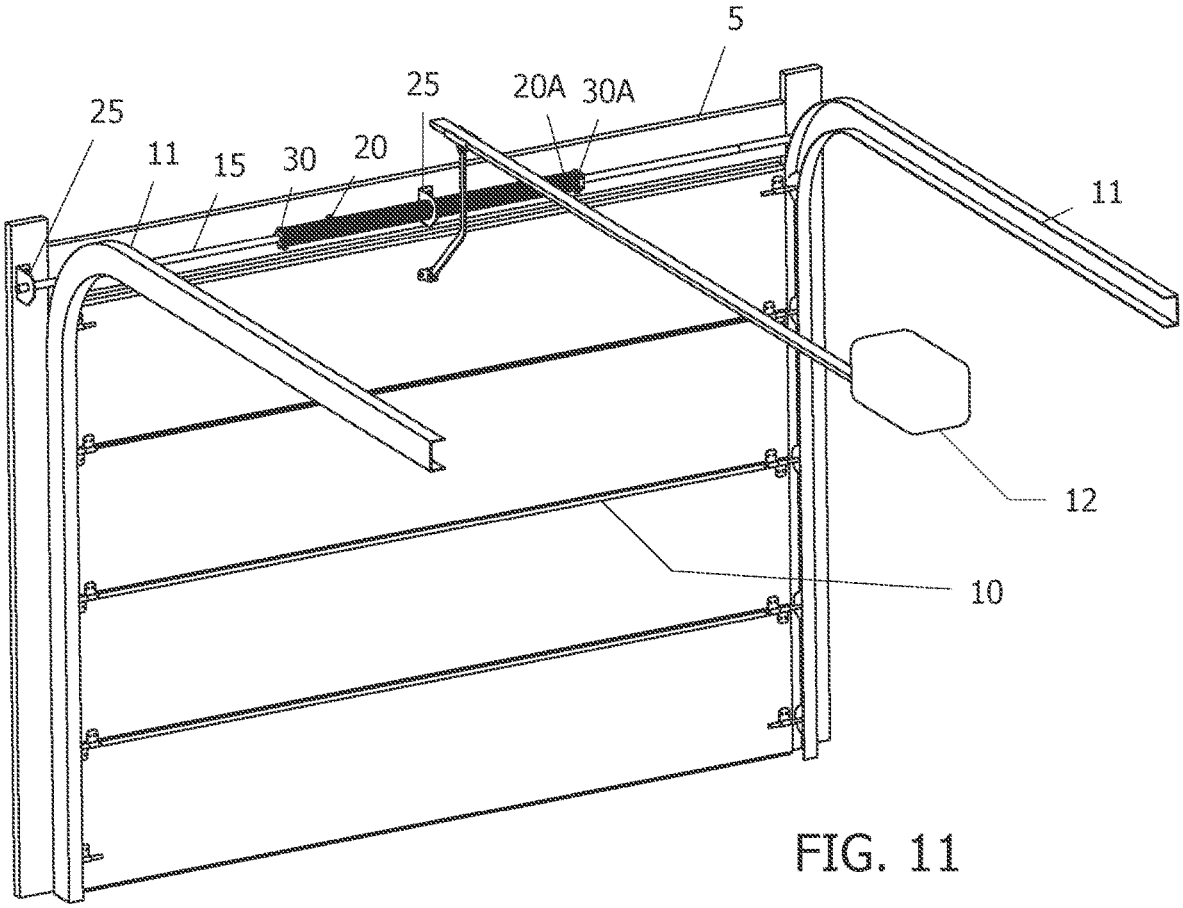
FIG. 11 is a perspective view of a garage door and two torsion springs.
Figure 12:
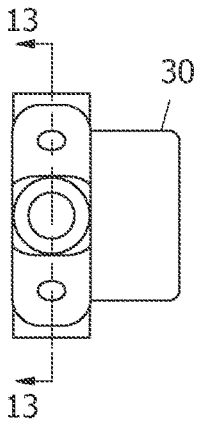
FIG. 12 is a side view of a spring cone.
Figure 13:
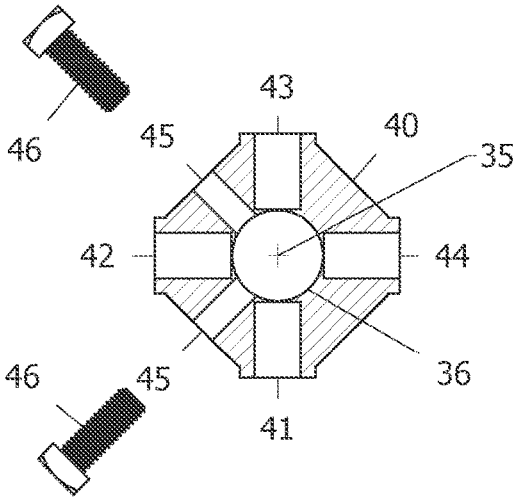
FIG. 13 is a cross-sectional view taken along line 13-13 in FIG. 12.

Turning first to FIGS. 11-13, it is seen that an overhead door 10 is provided. The door 10 can be deployed against a wall 5, or retracted to a storage positon adjacent the ceiling. A lift 12 can cause the door 10 to retract upon rollers housed within rails 11. A spring support 15 can support a torsion spring 20. A bearing plate 25 is fixed to the wall 5. One end of the torsion spring can be fixed with respect to the bearing plate. A spring cone 30 is also provided.

The spring cone 30 has a center 35 and a hole 36 therethrough. The spring cone 30 also has a perimeter 40. Four pockets 41, 42, 43 and 44, respectively, are preferably generally equally spaced about the perimeter 40. The pockets are open to the perimeter. Two screw holes 45 is also provided for receiving screws 46. The screw holes 45 are open to the center hole 36 and to the perimeter. While two holes 45 are shown, it is appreciated that more or fewer holes could be used without departing from the broad aspects of the present invention.

The spring cone 30 is concentric with the spring support 15. An end of the torsion spring 20 can be fixed to the spring cone 30. When the torsion spring has been set to a desired tension, the screw 46 can be advanced through the hole 45 until it contacts the spring support 15. This locks the torsion spring 20 in place with a desired spring load.

In some situations, a second torsion spring 20A and spring cone 30A are provided, depending on factors such as spring capacity, door weight and possibly other variables.

Turning now to FIGS. 1-10, it is seen that a first preferred embodiment of a tool 60 is illustrated. Tool 60 has a first bar 70, a second bar 90, a connector 110 and a cover 130. Each of these components are described below.

Bar 70 has a shaft 71 having a first end 72 and a second end 73. The shaft can be made of any material that is strong. Metal is a preferred material. Shaft 71 is preferably about ½ in diameter and about 18 inches in length. These dimensions are illustrative and not limiting. Two collars 75 and 76 are provided near the second end 73 of the shaft. The collars are spaced apart a selected distance. The collars 75 and 76 segregate the shaft 71 into three portions, namely: a handle 80, a seat 81 and a lug 82. The handle 80 is at the first end 72 of the shaft 71. The lug 82 is as the second end 73 of the shaft 71. The seat 81 is in between the handle 80 and the lug 82. The bar has a longitudinal axis 85. The shaft can have a generally round profile. It is appreciated that other profiles could be used without departing from the broad aspects of the present invention.

Bar 90 has a shaft 91 having a first end 92 and a second end 93. The shaft can be made of any material that is strong. Metal is a preferred material. Two collars 95 and 96 are provided near the second end 93 of the shaft. The collars are spaced apart a selected distance. The collars 95 and 96 segregate the shaft 91 into three portions, namely: a handle 100, a seat 101 and a lug 102. The handle 100 is at the first end 92 of the shaft 91. The lug 102 is at the second end 93 of the shaft 91. The seat 101 is in between the handle 100 and the lug 102. The bar has a longitudinal axis 105. The shaft can have a generally round profile. It is appreciated that other profiles could be used without departing from the broad aspects of the present invention.

Bar 70 and bar 90 can be identical to each other.

A connector 110 is further provided. The connector 110 has first end 120 and a second end 125 at opposite ends of a body. A first loop 121 is at the first end 120 of the body 115. A second loop 126 is at the second end 125 of the body 115. The connector 110 is preferably resilient and can be extended along its longitudinal axis. One preferred resilient member is a spring. The spring can be a wound spring with a preselected spring force. Loop 121 can be wrapped around shaft 71 in seat 81. Loop 126 can be wrapped around shaft 91 in seat 101.

A cover 130 having ends 131 and 132 is provided. The cover 130 is a shear-resistant sleeve through which loop 121 penetrates at penetration 133 (FIG. 10) before encircling seat 81. Likewise, loop 126 penetrates cover 130 at penetration 134 (FIG. 9) before encircling seat 101. The respective penetrations are through the ends of the cover interior of the end edges. The distance between sleeve penetrations 133 & 134 (longitudinal penetration separation distance) limits the maximum extension of the spring. It is appreciated that the cover 130 can limit the spring extension to a length sufficient to allow the bar to reach the adjacent pocket and a margin of error.

It is appreciated that in an alternative embodiment, that the loop 126 can penetrate cover 130 three times in the same manner and nearby to penetration 134. Likewise, it is appreciated that in an alternative embodiment, that the loop 121 can penetrate cover 130 three times in the same manner and nearby to penetration 133. Penetrating the cover more than one time at each end, the respective loops act as a draw string to cinch the ends of the cover around the connector ends. It is appreciated that, since the cover end penetrations are similarly located at each end of the cover, that the longitudinal penetration separation distance is the maximum connector extension distance permitted.

It is also appreciated that in an alternative embodiment, that the cover 130 can be removed and the connector 110 can operate without it.

Figure 14:
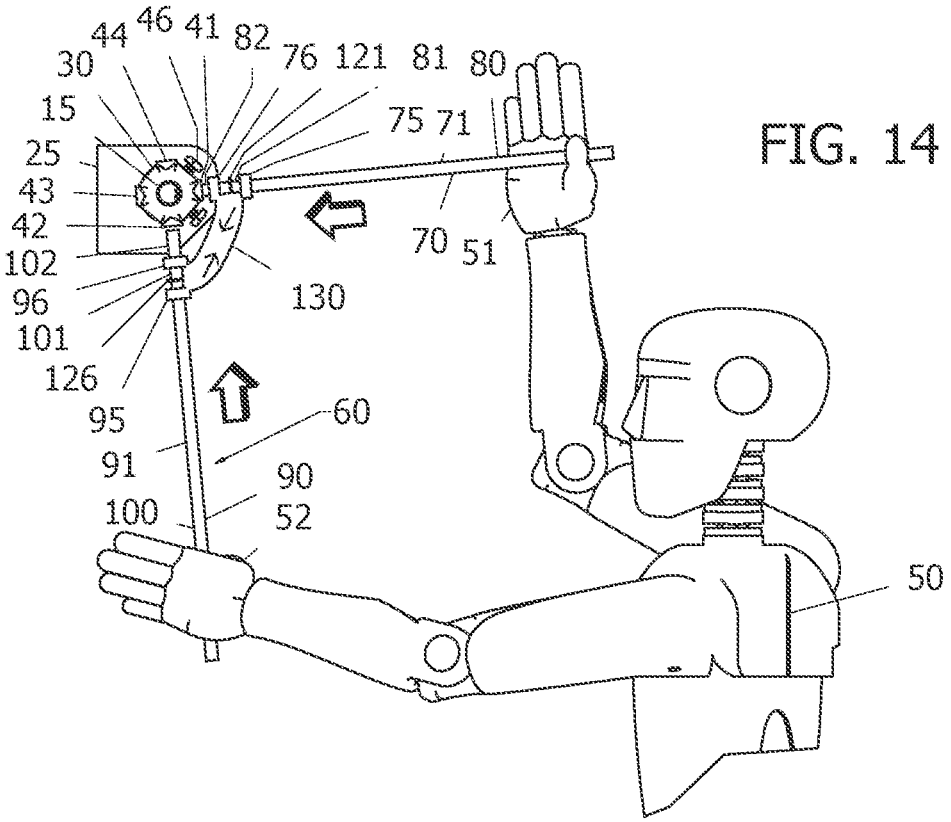
FIG. 14 is a side view showing a user using the present invention with one bar inserted into a winding cone and the second bar aligned with an adjacent pocket.
Figure 15:
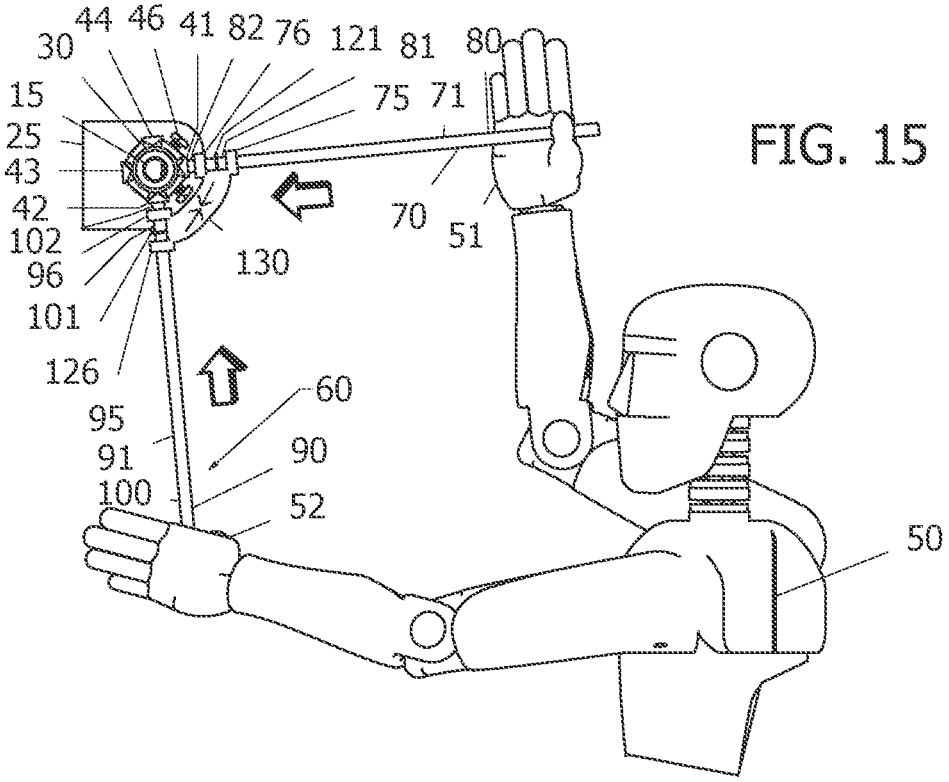
FIG. 15 is similar to FIG. 14, but shows the second bar received within the adjacent pocket.
Figure 16:
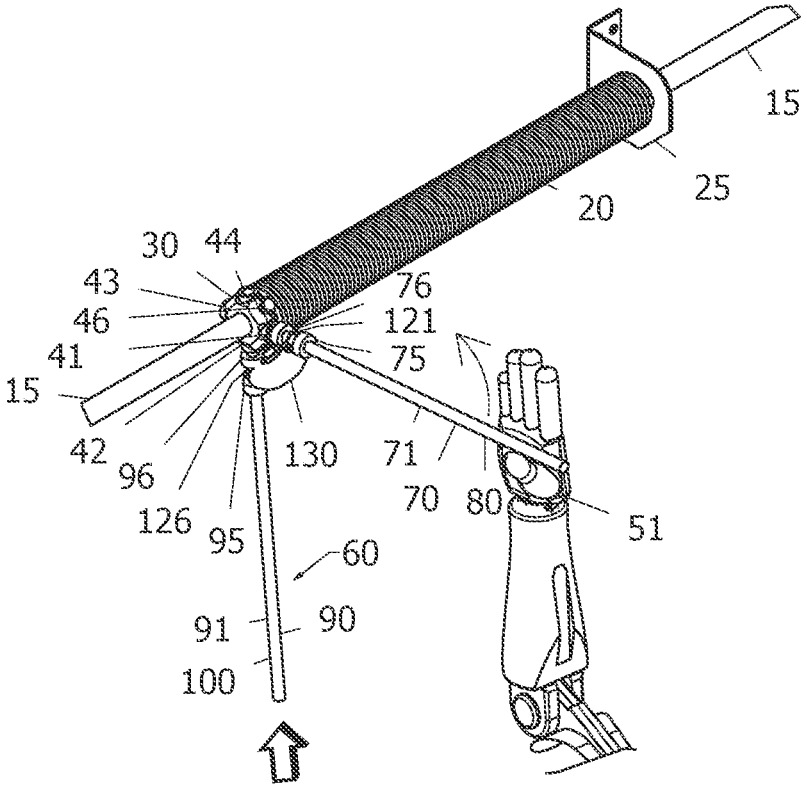
FIG. 16 is a perspective view showing the second bar being retained within a pocket due to spring force.
Figure 17:
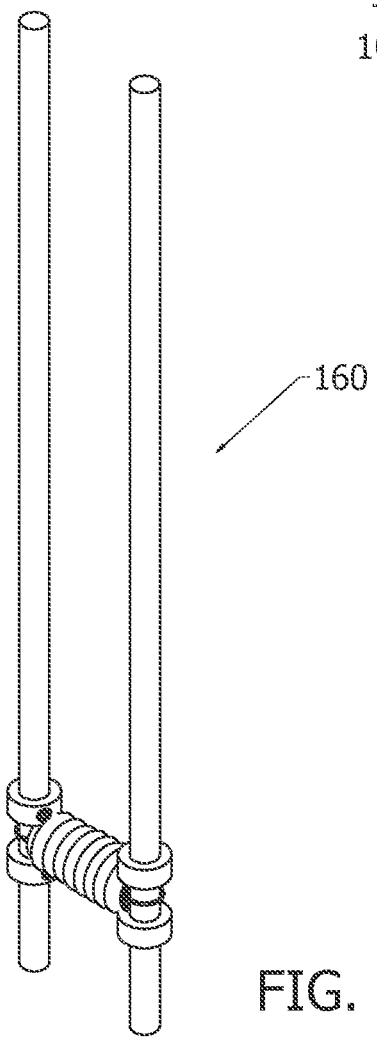
FIG. 17 is a perspective view of an alternative embodiment of the present invention.
Figure 18:
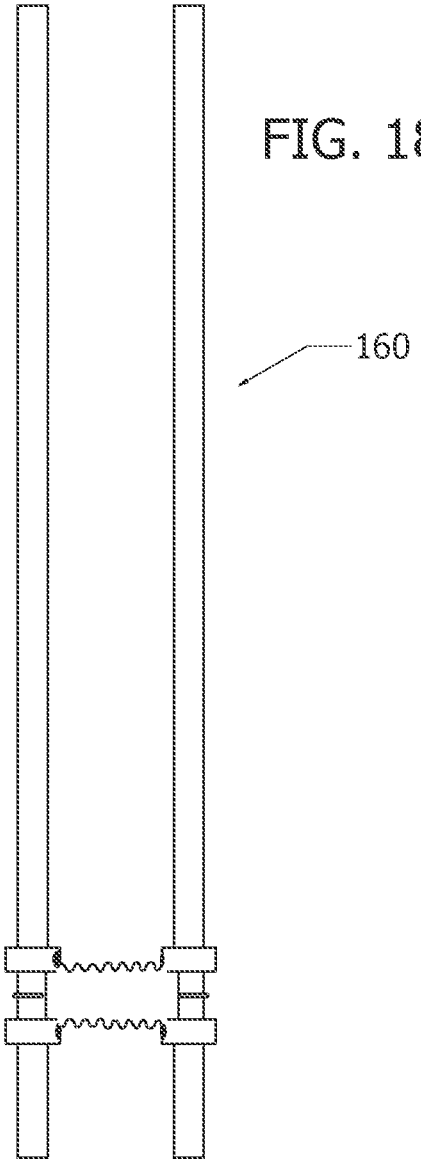
FIG. 18 is a side view of the embodiment illustrated in FIG. 17 shown with the connector in a retracted position.
Figure 19:
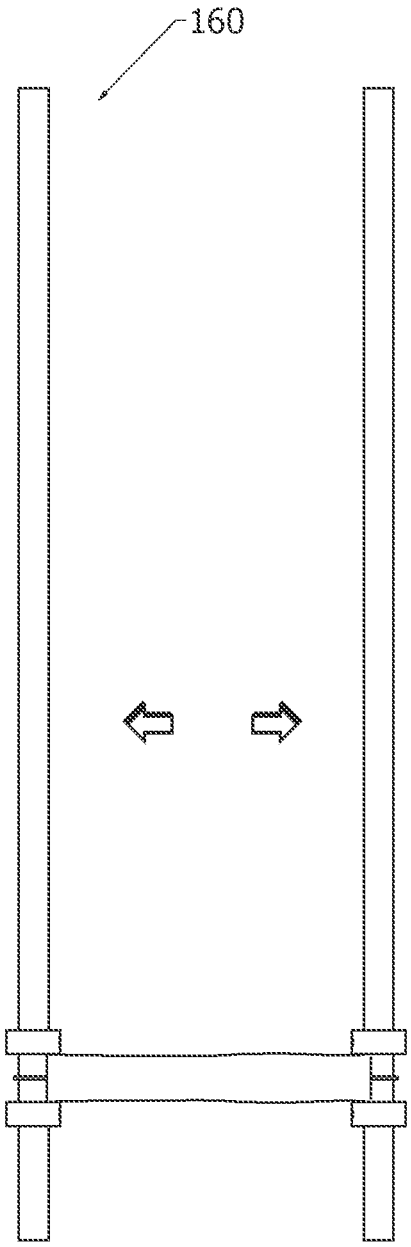
FIG. 19 is a side view of the embodiment illustrated in FIG. 17 shown with the connector in an expanded position.
Figure 20:
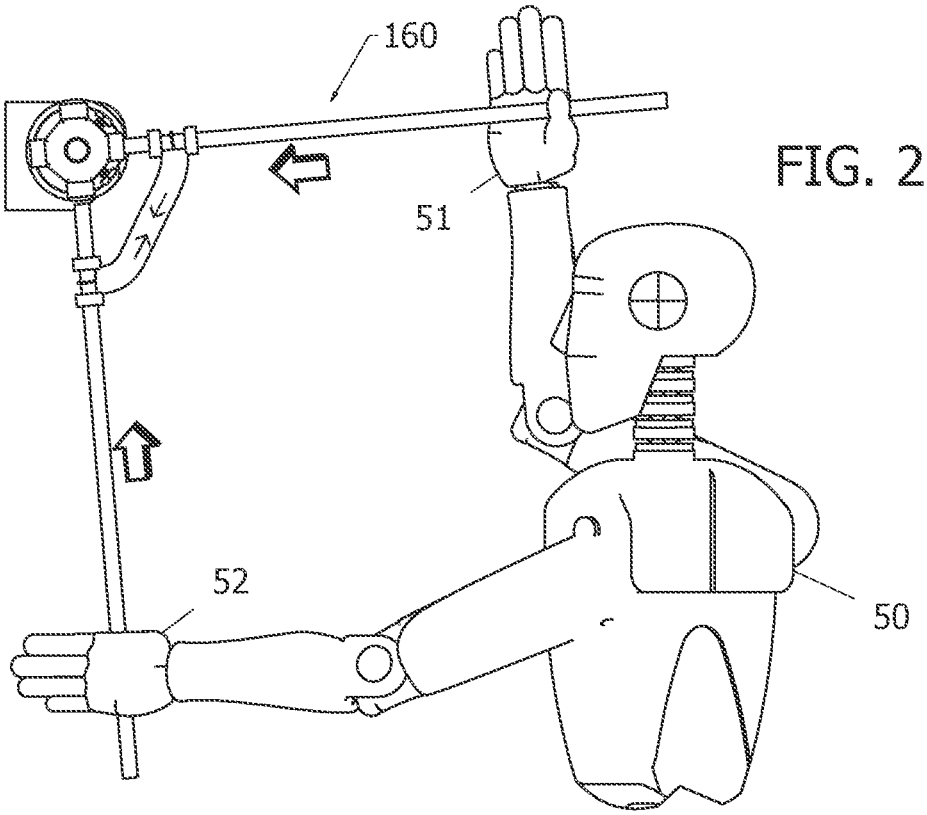
FIG. 20 is a side view of the embodiment illustrated in FIG. 17 showing a user using the present invention with one bar inserted into a winding cone and the second bar aligned with an adjacent pocket.
Figure 21:
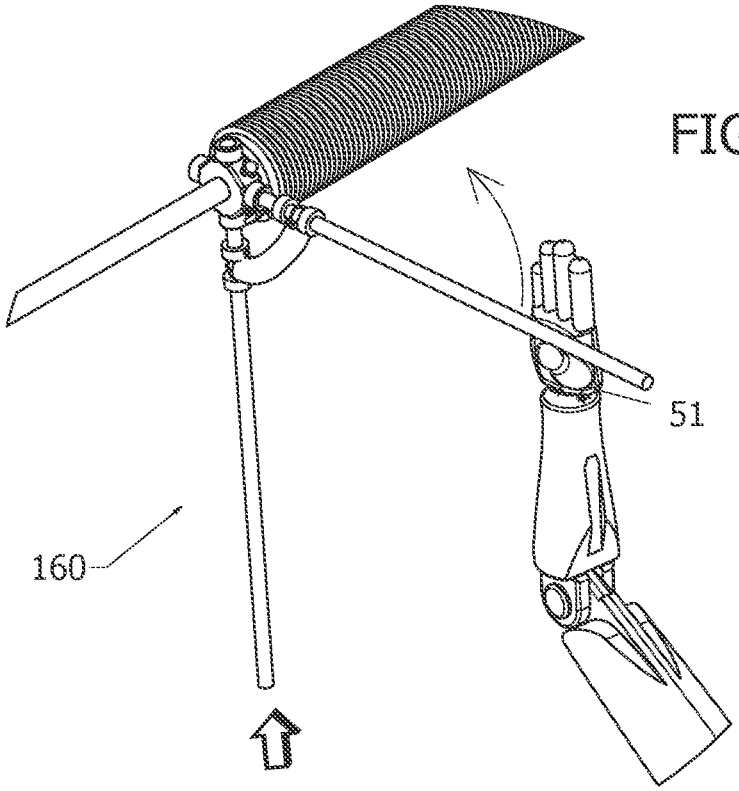
FIG. 21 is a perspective view of the embodiment illustrated in FIG. 17 showing the second bar being retained within a pocket due to spring force.

Turning now to FIGS. 14-16, it is seen how the tool 60 is used to wind spring 20. In this example, the spring has a diameter of approximately 2 inches. A user 50 can use their hands 51 and 52 to manipulate the tool 60 to wind the spring 20. Hand 51 can insert lug 82 of bar 70 into pocket 41 of the spring cone 30. The user can wind the spring 20 until the bar longitudinal axis 85 is close to or approximately horizontal. The second bar 90 can be aligned with the adjacent pocket 42. The user's hand 52 can aide in this alignment as the bars can be separated by resiliently expanding the connector 110. Then, when bar 90 is aligned, the generated spring force can move the lug 102 of bar 90 into the pocket 42. Bar 90 stays in place due to the spring force. The user can switch hands at this point if desired. Once bar 90 is firmly engaged by the user (to start winding), the user can remove bar 70 from pocket 41. Once bar 90 is moved to approximately being horizontal (approximately ¼ turn), then bar 70 can be aligned with and inserted into pocket 43. This process can be repeated a successive number of times by alternating the lug insertion into adjacent pockets until a desired spring tension is set. Then, screw or screws 46 can be used to lock the torsion spring 20 in place upon the spring support 15.

The torsion spring 20 can be unwound in a generally opposite manner. When the user has a firm grip on bar 70, which is received within a pocket 41, and bar 90 is received in pocket 42, the user may firmly grip either bar 70 or bar 90, then unsecure the screw 46. After a few degrees of rotation, bar 90 will rest against door 10 and resist rotation. The user can lift bar 70 to allow removal of bar 90 from pocket 42 so that bar 90 can be placed into pocket 44. Both bars can be rotated ¼ turn to release tension from torsion spring 20. When a user has a firm grip on bar 90, which is received in pocket 44, bar 70 can be removed from pocket 41 and inserted into pocket 43 and another ¼ turn of tension can be released from torsion spring 20. This process is repeated until all of the spring tension is released.

Turning now to FIGS. 17-21, it is seen that an alternative embodiment of the present invention is illustrated. In this embodiment, the tool 160 is larger than tool 60. More specifically, the tool 160 has shafts that are approximately ⅝ inch in diameter and approximately 24 inches in length. The tool 160 can be used with torsion springs having a four inch diameter. The method of operation of tool 160 in both winding and unwinding is the same as tool 60.

Figure 22:
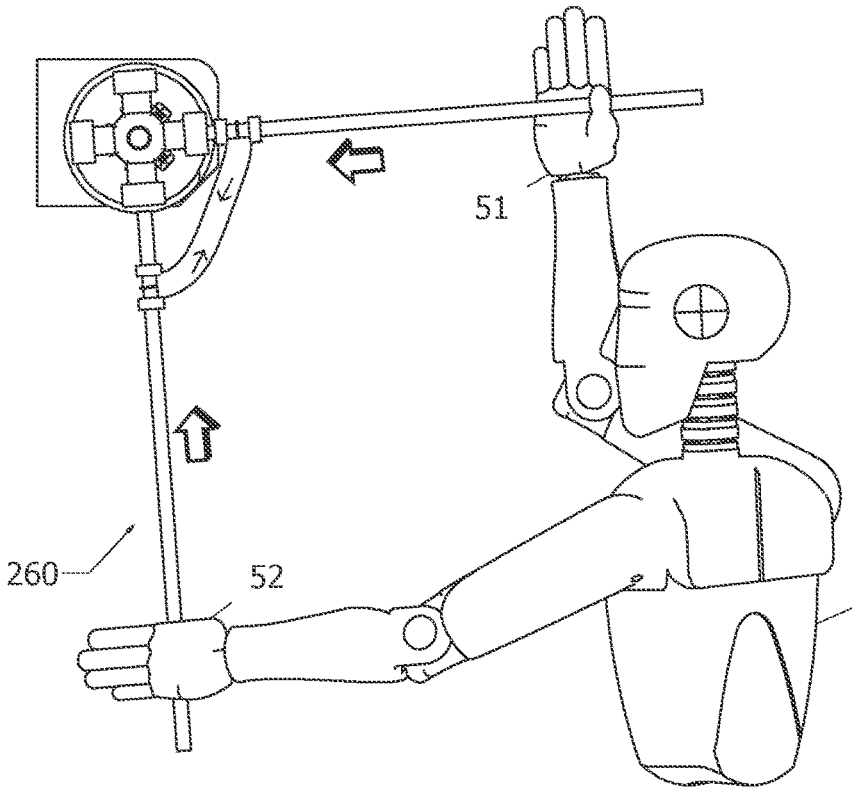
FIG. 22 is a side view of an alternative embodiment of the present invention showing a user using the present invention with one bar inserted into a winding cone and the second bar aligned with an adjacent pocket.
Figure 23:
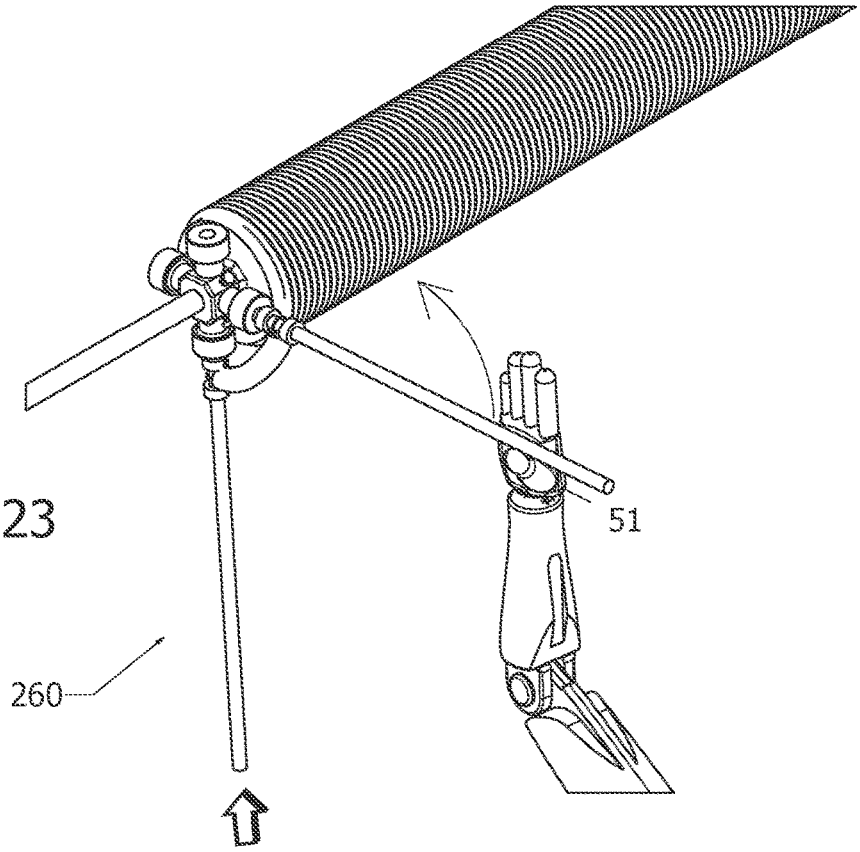
FIG. 23 is a perspective view of the embodiment illustrated in FIG. 22 showing the second bar being retained within a pocket due to spring force.

Turning now to FIGS. 22-23, it is seen that an alternative embodiment of the present invention is illustrated. In this embodiment, the tool 260 is larger than tool 60. More specifically, the tool 260 has shafts that are approximately ⅝ inch in diameter and approximately 24-36 inches in length. The tool 260 can be used with torsion springs having a six inch diameter. The method of operation of tool 260 in both winding and unwinding is the same as tool 60.

Thus it is apparent that there has been provided, in accordance with the invention, a torsion spring winding tool that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A tool for winding and unwinding a torsion spring via a spring cone having a plurality of pockets, said tool comprising:

a first bar, said first bar has a first bar shaft with a first bar shaft first end and a first bar shaft second end, said first bar further having a first bar first collar and a first bar second collar, said first bar first collar and said first bar second collar separating said first bar shaft into a first bar handle at said first bar shaft first end, a first bar lug at said first bar shaft second end, and a first bar seat between said first bar handle and said first bar lug;

a second bar, said second bar has a second bar shaft with a second bar shaft first end and a second bar shaft second end, said second bar further having a second bar first collar and a second bar second collar, said second bar first collar and said second bar second collar separating said second bar shaft into a second bar handle at said second bar shaft first end, a second bar lug at said second bar shaft second end, and a second bar seat between said second bar handle and said second bar lug;

a connector, said connector has a first loop at a connector first end, a second loop at a connector second end, and a spring between said first loop and said second loop, said first loop being connected to said first bar seat and said second loop being connected to said second bar seat; and a cover surrounding said spring, said cover having a first end with a first end edge and a second end with a second end edge, said connector penetrates said first end of said cover interior of said first end edge, and said connector penetrates said second end of said cover interior of said second end edge, wherein each of said first bar lug and said second bar lug are selectably insertable into and removable from one of the plurality of pockets.

2. The tool of claim 1 wherein:

said first loop is rotationally and longitudinally movable relative to said first bar seat;

said second loop is rotationally and longitudinally movable relative to said second bar seat.

3. The tool of claim 1 wherein:

said cover serving as a spring expansion limit, said cover having a longitudinal penetration separation distance between where said connector penetrates said first end of said cover and where said connector penetrates said second end of said cover, and said spring is selectably extendable along a spring longitudinal axis to a distance equal to said longitudinal penetration separation distance.

4. The tool of claim 1 wherein said connector biases said first bar seat towards said second bar seat when said connector is extended with a connector force, said connector force holding one of said first bar lug of said first bar and said second bar lug of said second bar in one of the plurality of pockets of the spring cone when a user is handling the other of said first bar and said second bar when winding and unwinding the torsion spring.

5. The tool of claim 1 wherein:

said first bar second collar is a depth indicator of said first bar lug; and said second bar second collar is a depth indicator of said second bar lug.

6. The tool of claim 1, wherein:

said first bar first collar is parallel to said first bar second collar, and said first bar lug is perpendicular to said first bar second collar; and said second bar first collar is parallel to said second bar second collar, and said second bar lug is perpendicular to said second bar second collar.

7. A tool for winding and unwinding a torsion spring via a spring cone having a plurality of pockets, said tool comprising:

a first bar having a first bar shaft with a first bar shaft first end and a first bar shaft second end, said first bar further having a first bar first collar and a first bar second collar, said first bar first collar and said first bar second collar separating said first bar shaft into a first bar handle at said first bar shaft first end, a first bar lug at said first bar shaft second end, and a first bar seat between said first bar handle and said first bar lug, said first bar first collar being parallel to said first bar second collar, and said first bar lug being perpendicular to said first bar second collar;

a second bar having a second bar shaft with a second bar shaft first end and a second bar shaft second end, said second bar further having a second bar first collar and a second bar second collar, said second bar first collar and said second bar second collar separating said second bar shaft into a second bar handle at said second bar shaft first end, a second bar lug at said second bar shaft second end, and a second bar seat between said second bar handle and said second bar lug, said second bar first collar being parallel to said second bar second collar, and said second bar lug being perpendicular to said second bar second collar; and a connector connected to said first bar seat and to said second bar seat, wherein each of said first bar lug and said second bar lug are selectably insertable into and removable from one of the plurality of pockets.

8. The tool of claim 7 wherein said connector is a spring made of wire that is extendable along a connector longitudinal axis.

9. The tool of claim 8 wherein:

said connector has a first loop at a connector first end and a second loop at a connector second end;

said first loop is rotationally and longitudinally movably connected to said first bar seat; and said second loop is rotationally and longitudinally movably connected to said second bar seat.

10. The tool of claim 9 wherein:

said tool has a cover with a cover first end with a first end edge, and a cover second end with a cover second end edge;

said connector penetrates said cover first end at least one time interior of said first end edge;

said connector penetrates said cover second end at least one time interior of said second end edge;

said cover serves as a spring expansion limit, said cover having a longitudinal penetration separation distance between where said connector penetrates said first end of said cover and where said connector penetrates said second end of said cover; and said cover surrounds said spring, said connector being selectably extendable along said connector longitudinal axis to a distance equal to said longitudinal penetration separation distance.

11. The tool of claim 7 wherein:

said first bar seat is separated from said first bar lug with a first bar lug depth indicator; and said second bar seat is separated from said second bar lug with a second bar lug depth indicator.

* * * * *